United States Patent [19]

Gremert et al.

[11] 4,396,127

[45] Aug. 2, 1983

[54] TWIN-TYPE SLEWING CRANE

[75] Inventors: Gote O. Gremert, Ornskoldsvik; Salomon E. Lundkvist, Sjalevad, both of Sweden

[73] Assignee: Aktiebolaget Hagglund & Soner, Ornkoldsvik, Sweden

[21] Appl. No.: 281,857

[22] Filed: Jul. 9, 1981

Related U.S. Application Data

[60] Continuation of Ser. No. 100,382, Dec. 5, 1979, abandoned, which is a division of Ser. No. 839,995, Oct. 6, 1977, Pat. No. 4,196,815.

[30] Foreign Application Priority Data

Oct. 8, 1976 [SE] Sweden ..... 7611188

[51] Int. Cl.[3] ..... B66C 23/06

[52] U.S. Cl. ..... 212/233; 308/174

[58] Field of Search ..... 212/190–192, 212/194, 233, 247; 308/174, 177–178

[56] References Cited

U.S. PATENT DOCUMENTS

| | | | |
|---|---|---|---|
| 677,281 | 6/1901 | Seagrave et al. | 308/174 |
| 1,207,423 | 12/1916 | Lundin | 212/233 |
| 1,244,153 | 10/1917 | Wickwire | 212/233 |
| 1,910,028 | 5/1933 | McElroy et al. | 308/174 |
| 2,414,573 | 1/1947 | Wagner et al. | 308/174 X |
| 3,302,986 | 2/1967 | Grolman et al. | 308/174 |
| 3,391,810 | 7/1968 | Le Tourneau | 212/247 |
| 4,023,868 | 5/1977 | Miki | 308/174 |
| 4,197,953 | 4/1980 | Frick | 212/233 |

FOREIGN PATENT DOCUMENTS

| | | | |
|---|---|---|---|
| 1556466 | 6/1970 | Fed. Rep. of Germany. | |
| 1965649 | 7/1971 | Fed. Rep. of Germany | 212/192 |
| 1965651 | 7/1971 | Fed. Rep. of Germany | 212/192 |
| 2064468 | 12/1971 | Fed. Rep. of Germany | 212/192 |
| 37191 | 3/1965 | German Democratic Rep. | 212/190 |
| 1332358 | of 1962 | France . | |
| 1484597 | of 1966 | France . | |
| 1577034 | 6/1969 | France . | |

*Primary Examiner*—Trygve M. Blix
*Assistant Examiner*—R. B. Johnson
*Attorney, Agent, or Firm*—Cushman, Darby & Cushman

[57] ABSTRACT

Two mechanically identical cranes whose luffing jibs have the same maximum and minimum out-reach and which have their own slewing machinery, are mounted via respective supporting structures on a common foundation, at the same level for rotation about the same axis by bearings and an axle which provide a compact journalling of the supporting structures upon the foundation.

1 Claim, 6 Drawing Figures

TWIN-TYPE SLEWING CRANE

This is a continuation of application Ser. No. 100,382 filed Dec. 5, 1979 (and abandoned in favor hereof) which was a division of application Ser. No. 839,995, filed Oct. 6, 1977, now U.S. Pat. No. 4,196,815, issued Apr. 8, 1980.

BACKGROUND OF THE INVENTION

Twin-type slewing cranes are used for handling loads on board ship, the individual cranes which together make up the twin cranes being either used singly to load and unload individual holds, or in combination for moving heavy freight.

Ordinary twin slewing cranes have a large mass (weight) and are expensive as well, since each single crane is constructed and arranged in such a way as to allow an individual slewing motion. Each crane is thus rotatably arranged on a common platform which itself can be rotated round a foundation firmly anchored in the hull of the ship. Such cranes have three slewing rims, three gear rings, three slewing mechanisms and, in addition, a large common platform. This type of construction makes for complex and expensive assembly procedures and leads to high costs of transport, assembly, inspection and maintenance.

Another type of twin slewing cranes using only a single gear ring and a slewing rim is sometimes met with. This rim, or bearing, however, is constructed so as to provide a double pivoting link, that is, two bearing functions are combined so that the middle race of the bearing is attached both to the foundation of the crane and to the gear ring, while the outer race of the bearing is connected by a collar arm to one crane, and the inner race is connected, by another collar arm, to the other crane. This type of bearing is very special, and since it produces a slewing rim of very large diameter it is extremely expensive and difficult to repair or replace if it is damaged. In addition to this, the positions of the collar arms in relation to the bearing require different mechanical constructions in each crane while at the same time the slewing mechanisms in each crane must be mounted differently, in one the driving motor is mounted upwards, in the other it is mounted downwards. Disadvantages are complications of construction and assembly of the mechanism and the fact that, e.g. the driving motors must be differently designed to allow drainage of condensing water.

SUMMARY OF THE INVENTION

The invention concerns a duplex slewing crane where both cranes are located at the same distance from a common vertical axis, where both are provided with a luffing jib and, in relation to one another, are able to function within a large angle of rotation, and where, whenever necessary, both cranes are able to work together and thus are adjustable to any given angle of rotation.

The aim of the invention is to solve the problem of combining two mechanically identical cranes whose luffing jibs have the same maximum and minimum outreach, two slewing machineries and one slewing rim, and to simplify the construction of a supporting bearing safe to rotate and tip so that assembly becomes as simple and cheap as possible at the same time as the desired functions are achieved in operation of both one and two cranes.

Two mechanically identical cranes whose luffing jibs have the same maximum and minimum out-reach and which have their own slewing machinery, are mounted via respective supporting structures on a common foundation, at the same level for rotation about the same axis by bearings and an axle which provide a compact journalling of the supporting structures upon the foundation.

These aims are achieved through invention, details of which are described in the following application for a patent.

The invention is described below by reference to the appended drawing figures showing the construction of a twin slewing crane.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
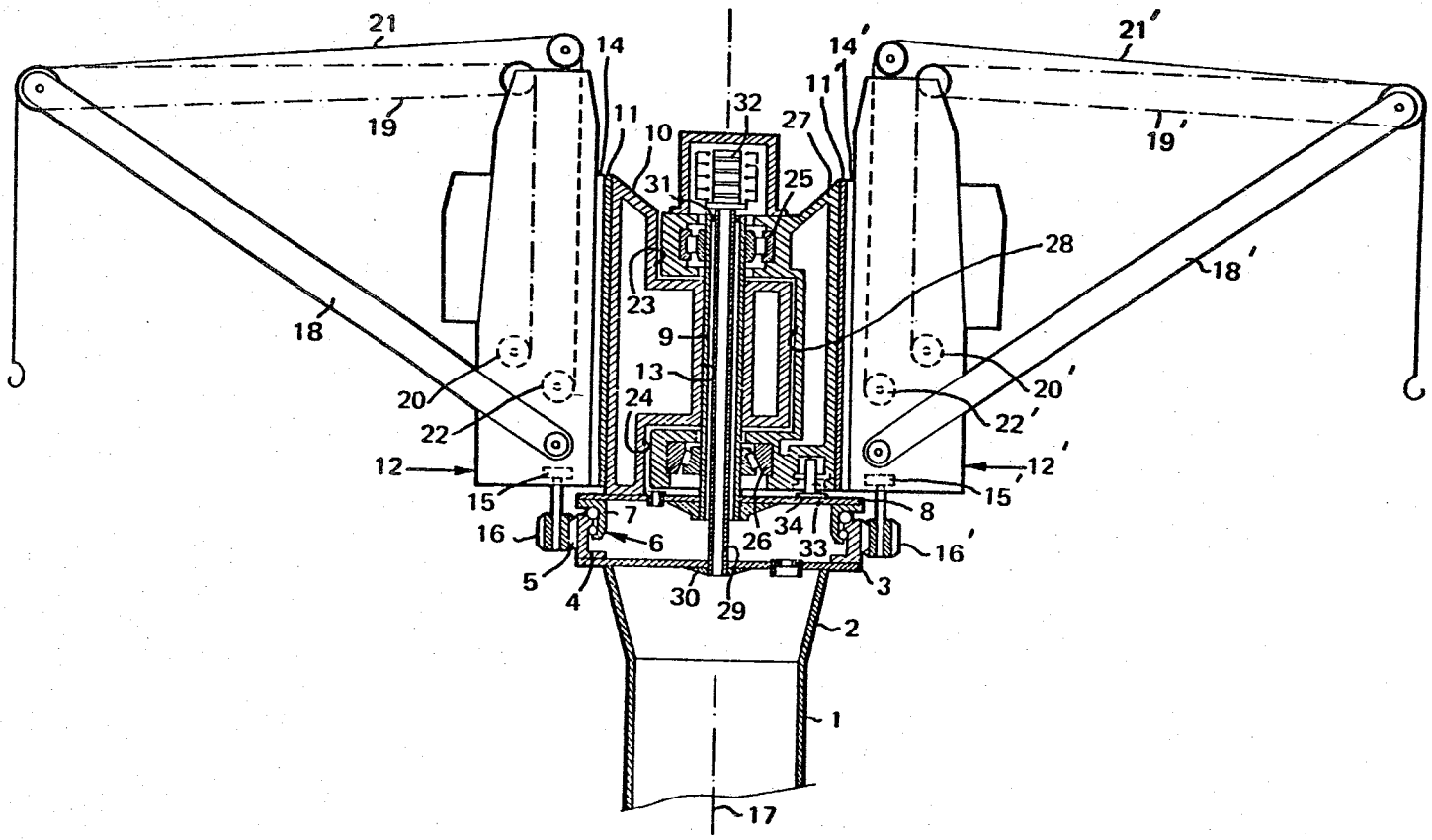
FIG. 1 shows a side view partly in section, of a first version of a twin slewing crane according to this invention.

In the first version (FIG. 1), a foundation 1 having a conical head 2 and provided with an end plate 3 is shown mounted on the hull of a ship, not illustrated here. On this end plate 3 is mounted an outer race 4 with a gear ring 5, to a simple ball or roller-bearing connection, or so-called slewing rim, generally designated 6. The inner race 7 of this slewing rim 6, mounted on the outer race 4, is securely screwed to a base plate 8. To this base plate 8 are attached a hollow vertical bearing-mounted axle 9 and a primary supporting structure 10 with a vertical supporting plate 11 to which the first crane 12 is attached. The axle 9 runs through a vertical, circular hole 13 in the supporting structure 10 to which it is here attached. This allows the axle 9 to rotate simultaneously with the inner race 7 of the slewing rim 6 and the base plate 8. Bolts, not illustrated here, are used to connect the supporting plate 11 with a vertical back plate 14 on the crane 12. This crane 12 is provided with a slewing machinery 15 which, by means of a gear 16, extending downwards and rotating against the gear ring 5, slews the crane 12 around the slewing axis of the base of the crane 12, here designated 17. In the version illustrated here, the crane 12 is equipped with a luffing jib 18, luffing rope 19, luffing machinery 20, hoisting wire 21 and a hoisting machinery 22.

The primary supporting structure 10 is provided with upper and lower horizontal recesses, 23 and 24, in which the secondary supporting structure 27, also designated slewing structure, provided with recess 28 and rotating round the vertical bearing-mounted axle 9, is mounted on upper and lower roller bearings 25 and 26. The slewing structure 27 is provided with a vertical plate 11' supporting the second crane 12', like the first crane 12, this supporting plate 11' is bolted into a back plate 14' fastened to the back of the second crane 12'. The slewing structure 27 of the second crane 12' is thus mounted on the supporting structure 10 of the first crane 12 by means of the vertical bearing-mounted axle 9. Both supporting structures 10 and 27 are located at equal heights and above the gear ring 5, and also each of the cranes 12 and 12'. The construction of the second crane 12' is identical with that of the first crane, and through the action of the slewing machinery 15' and its gear 16', which, like the first crane 12 rotates against the gear ring 5, it can be made to rotate relative to the first crane 12 and the vertical bearing-mounted axle 9, and thereby, of course, around the slewing axis 17 of the crane base as well.

A connecting tube 29 runs through the vertical bearing mounted axle 9. The lower end of this tube is attached to a bracket 30 fastened to the end plate 3, while the upper end is mounted in the vertical bearing-mounted axle 9 by means of a bearing 31. The tube 29 comprises a slip-ring device 32 for the provision of electricity to the cranes 12 and 12'.

In order to offset tip, the second crane 12' is when necessary provided with one or more travelling wheels 33 moving in a circular track attached to the base plate 8.

Figure 2:
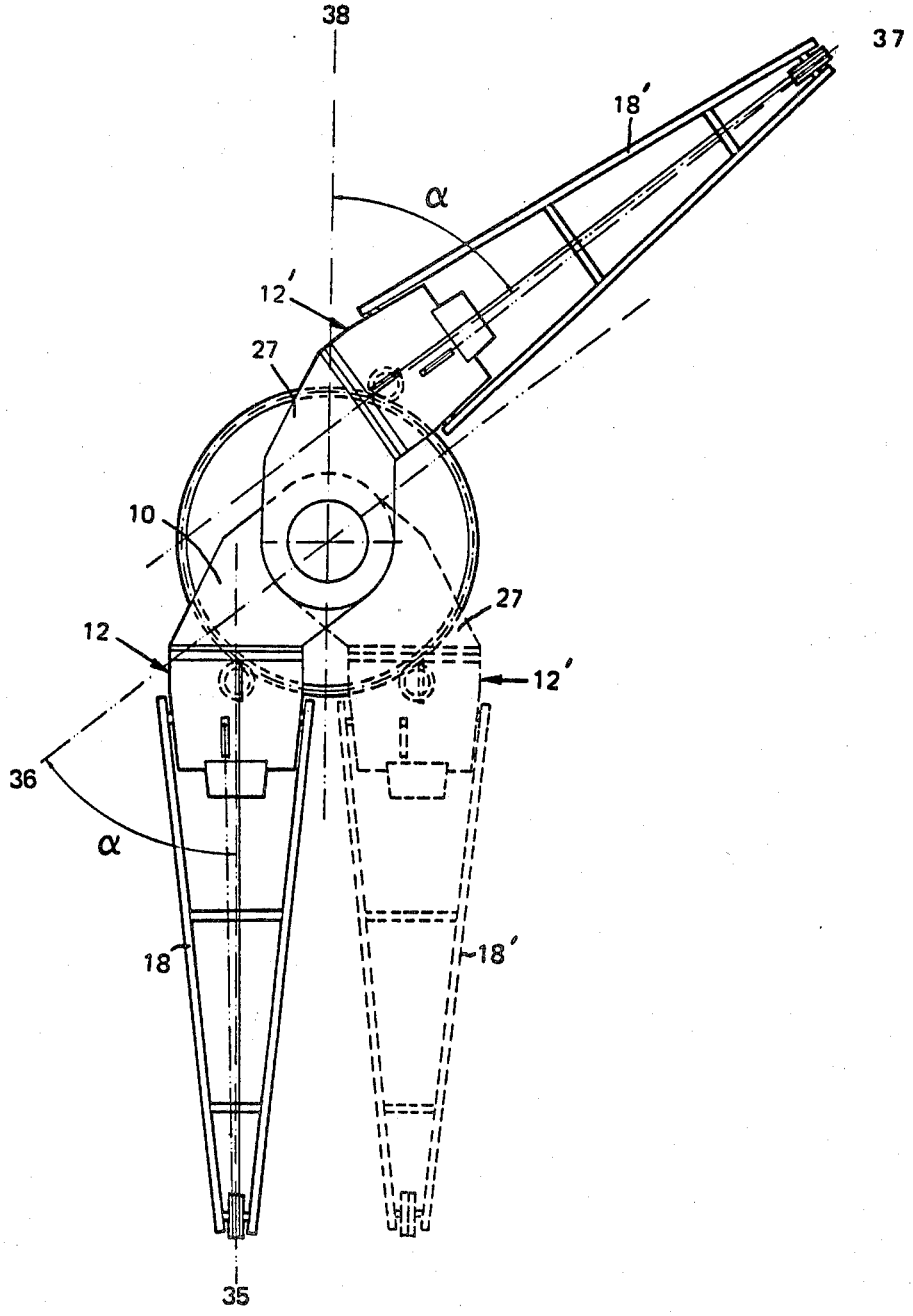
FIG. 2 shows a plan view of FIG. 1, the cranes being illustrated for use singly or together.

FIG. 2 shows how each crane 12 and 12' can work individually and how the second crane 12' can be maneuvered into a position shown here in dotted lines next to the first crane 12 enabling both to work together as a twin slewing crane. The angle of rotation of the second crane 12' relative to the first crane 12 is at least 180°. If both cranes are slewed simultaneously the angle of rotation is unlimited. If both are working together, the cranes 12 and 12' being locked into position beside one another not illustrated here, the angle of rotation is unlimited.

The supporting structure 10 and slewing structure 27 are built so that they form an angle in order to be able to bring the cranes 12 and 12' into a position where they are roughly parallel with each other and to achieve a suitable distance between the load hooks. The angle $\alpha$ between the centre line 35 of the first luffing jib 18 and the centre line 36 of the supporting structure, and between the centre line 37 of the second luffing jib 18' and the centre line 38 of the slewing structure 27, is thus less than 90°.

If both cranes are to be operated simultaneously, the luffing machineries 20 and 20' and the hoisting machineries 22 and 22' must be synchronized so that the movement of the jibs and hoisting ropes are equal. The slewing machineries 15 and 15', too, must be synchronized in order to allow the simultaneous rotation of the cranes 12 and 12', unless one machinery is powerful enough to be able to slew both cranes alone. This twin slewing crane is thus capable of handling loads twice as heavy as the maximum working load of a single crane.

Figure 3:
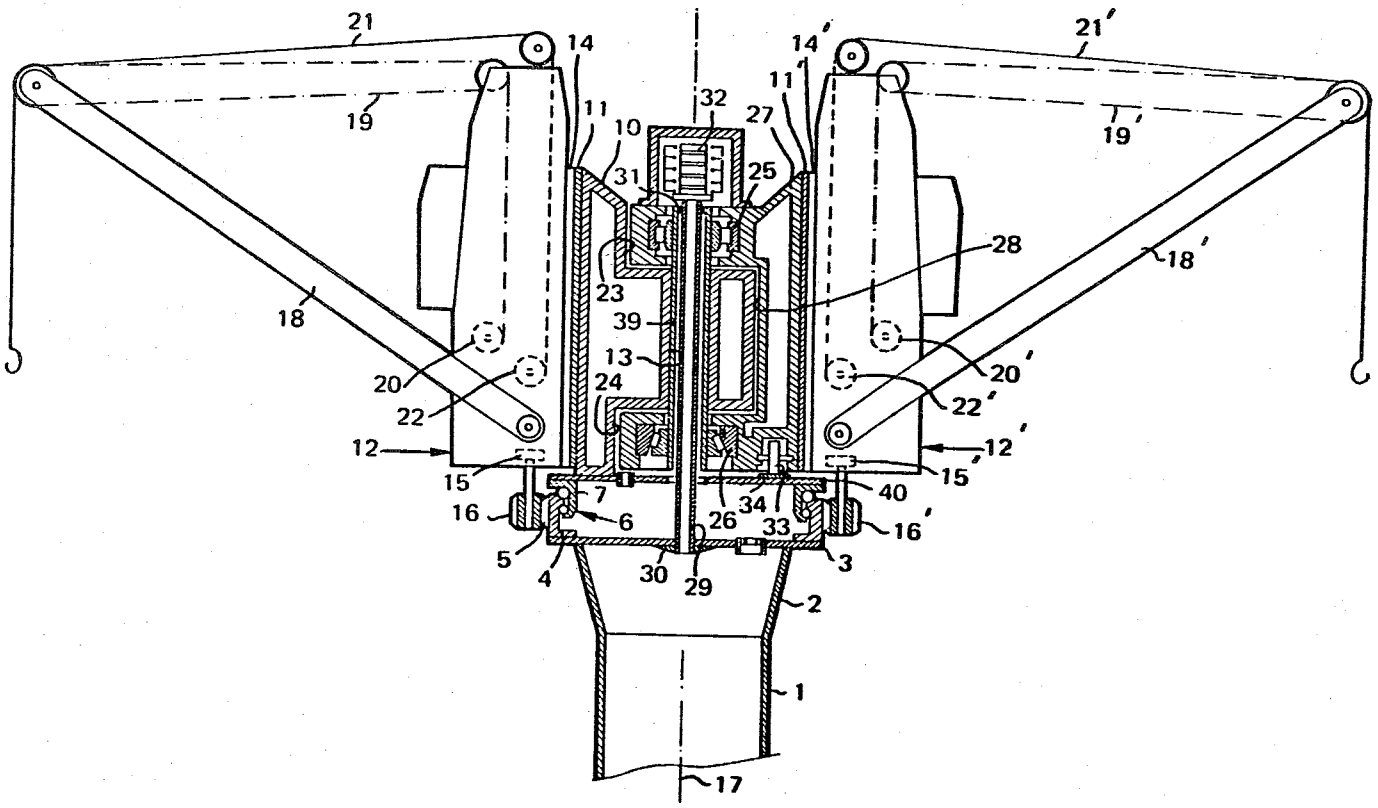
FIGS. 3, 4 and 5 show side views, partly in section, of second, third and fourth versions of a duplex slewing crane according to this invention.

FIG. 3 shows another version of a twin slewing crane, from which it is apparent that the bearing-mounted axle 9 attached to the base plate 8, illustrated in FIG. 1, has been replaced by a tubular, vertical axle 39 attached to the primary supporting structure 10 but not to the base plate 40. In this version, the function of the axle 39 is simply to serve as a hinge on which the second crane 12' is suspended by means of bearings 25 and 26, and around which the second crane 12' can be made to rotate relative to the first crane 12.

The version to be used is determined by the mechanical dimensions of the crane with regard to operational loads and stress.

Figure 4:
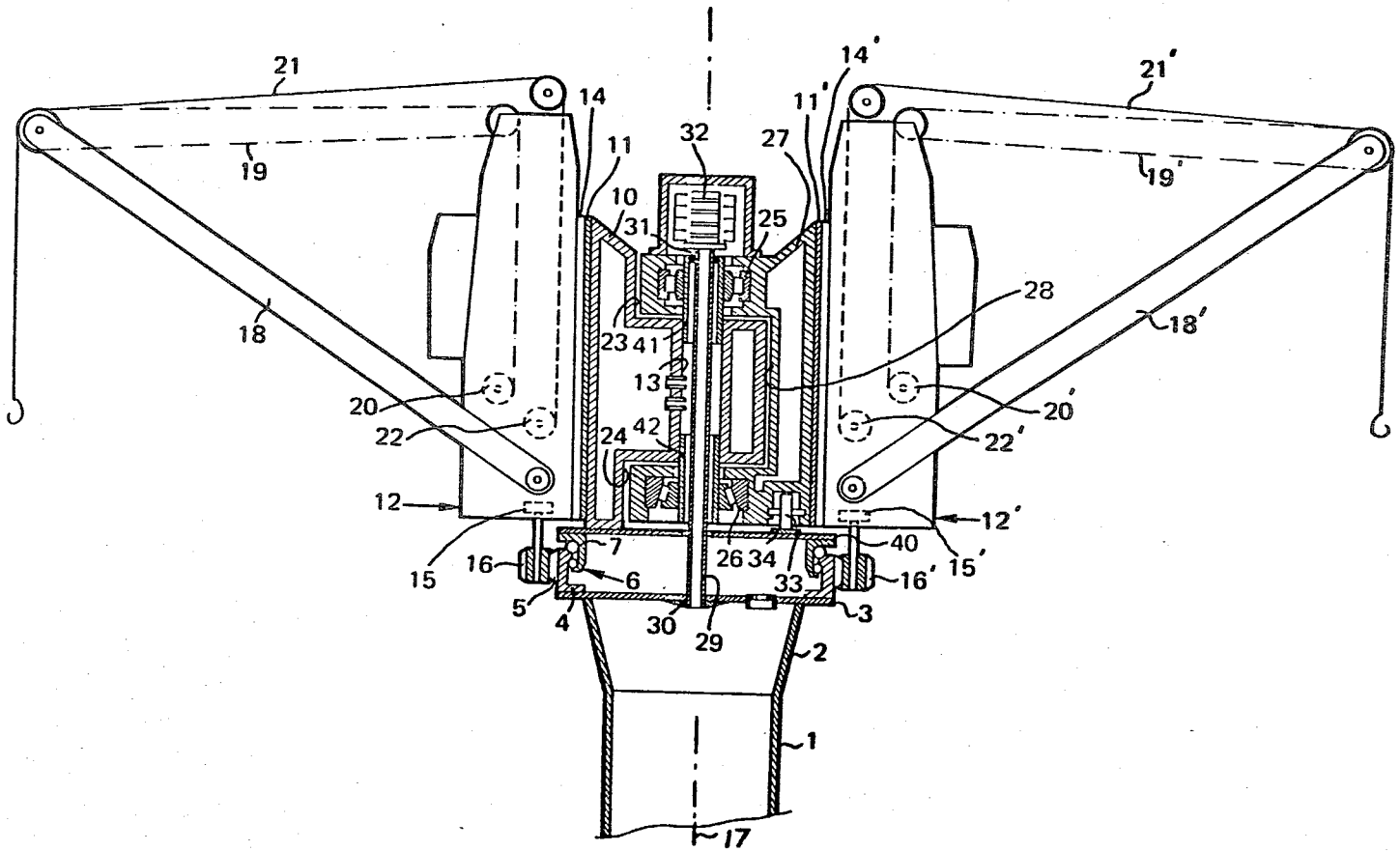

FIG. 4 shows a third version of a twin slewing crane, from which it is apparent that the axle 39, illustrated in FIG. 3, has been replaced by upper and lower tubular stubs, 41 and 42. These are attached to the supporting structure 10 but not to the base plate 40. The tubular stubs function as pivot pins on which the second crane 12' is suspended by means of bearings 25 and 26 and round which the second crane 12' can be made to rotate relative to the first crane 12.

Figure 5:
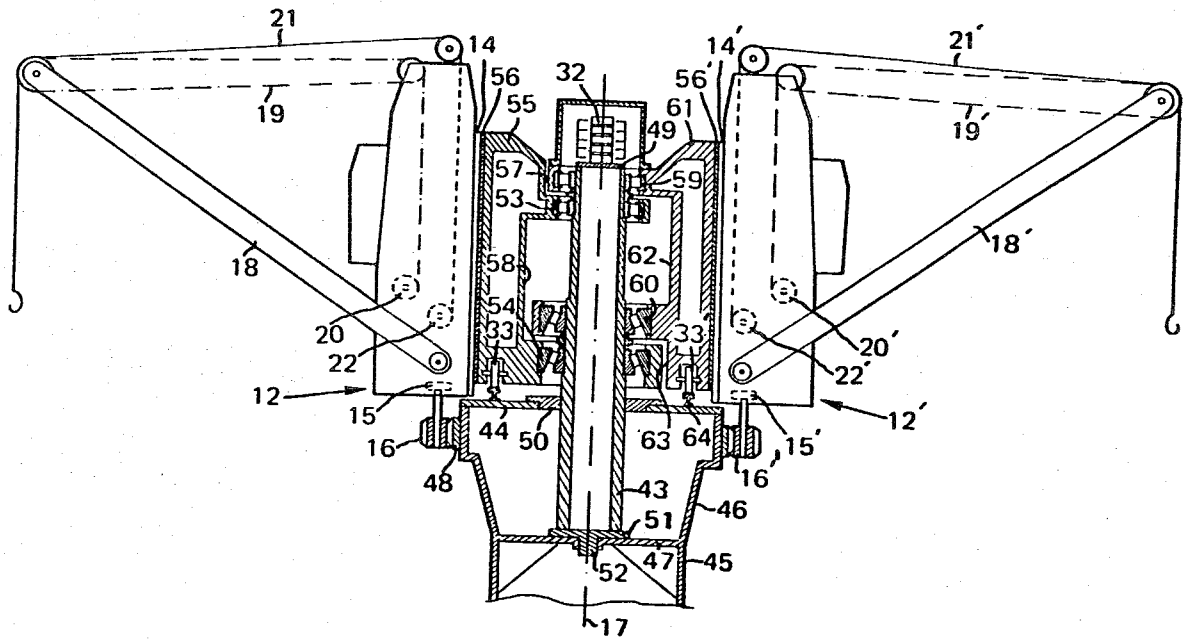

FIG. 5 shows a fourth version of a twin slewing crane, from which it is apparent that, unlike FIGS. 1, 3 and 4, there is no slewing rim per se, that both cranes 12 and 12' are suspended on a hollow, non-rotating vertical column axle 43 and that the base plate, here designated 44, is fixed to the foundation 45 of the crane.

The foundation 45 of the crane has a conical head 46, a twin supporting plate 47 and the base plate 44 just mentioned. These two plates are rigidly mounted and cannot rotate. A gear ring 48 is mounted on the foundation of the crane 45, into which the gears, 16 and 16', of the slewing machineries, 15 and 15', of the individual cranes 12 and 12' mesh. The upper end of the vertical column axle 43 is covered by a plate 49 supporting a slip-ring device 32 and is fitted with a bearing flange 50, located at some distance away from the lower end of the axle, and a supporting flange 51 with a stub axle 52 at its lower end. Stability of the vertical column axle 43 is achieved by fixing the supporting flange 51 and stub axle 52 firmly to the supporting plate, while the bearing flange 50 is attached to the base plate 44. The primary supporting structure 55, mounted on the axle 43 by means of upper and lower roller bearings 53 and 54, carries a vertical supporting plate 56 to which the first crane 12 is attached. This supporting plate 56 is fastened by bolts, not illustrated here, to a vertical plate 14 on the back of the crane 12. The primary supporting structure 55 is provided with upper and lower horizontal recesses, 57 and 58, in which the secondary supporting structure 61, which rotates around the vertical column axle 43, is mounted on upper and lower roller bearings 59 and 60. The secondary supporting structure 61 is provided with upper and lower horizontal recesses 62 and 63, into which the roller bearings 53 and 54 mentioned above, running round the vertical column axle 43 are fitted. The secondary supporting structure 61 has a vertical plate 56 which carries the second crane 12' and which, like the first crane 12, is fastened by bolts to a plate 14' attached to the back of the second crane 12'. The construction is otherwise the same as shown in FIGS. 1, 3 and 4. The cranes 12 and 12', working both singly and together, move in the same way as those shown in the first version.

In order to offset the downward pull of the first and second cranes 12 and 12', each is provided, if their size should make it necessary, with one or more travelling wheels, 33 and 33', moving on a circular track 64 attached to the base plate 44.

The version shown in FIG. 5 has the advantage that instead of the large slewing rim with two smaller roller bearings as used in the first, second and third versions illustrated in FIGS. 1, 3 and 4, four small roller bearings can be used which do away with the difficulty of obtaining an expensive slewing rim manufactured in small series only, and which allow roller bearings to be used which can be manufactured in large series and are hence cheaper and more standardized.

Figure 6:
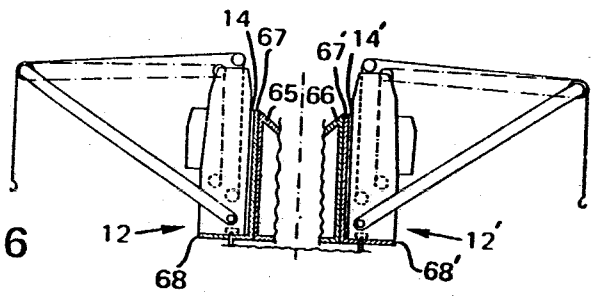
FIG. 6 shows, in highly simplified form, the underlying principles of a variant of the supporting structures of the twin crane as shown in FIGS. 1, 3, 4 and 5.

FIG. 6 shows, in highly simplified form, the fundamental principle of a variant of the supporting structures of the cranes 12 and 12'. The structures, here designated 65 and 66, are provided with vertical supporting plates 67 and 67' which at their lower end have horizontal projections, 68 and 68'. By this arrangement, the vertical plates 14 and 14' on the back of the cranes 12 and 12' can be bolted to the supporting plates 67 and 67' while the bottom of the cranes can be bolted to the projections 68 and 68', thus increasing the strength of the attachment of the cranes to their supporting structures 65 and 66. In certain smaller versions of this crane type, bolting the cranes to the projections only would be sufficient.

The advantages offered by twin slewing cranes of the type described here may be summarized as follows:

(A) By using a vertical bearing axle, an articulated axle or tubular axle stubs combined with the structures supporting each crane, and by attaching the crane to a base plate which can be rotated on a slewing rim in the versions of FIGS. 1–4 (and 6), a single slewing rim and two mechanically identical cranes without individual slewing rim or gear rings can be used.

(B) By using a simple vertical column axle in the version of FIG. 5 (and 6), a number of roller bearings and supporting structures to carry the individual cranes, even the single slewing rim mentioned in (A) above can be avoided. Here, too, mechanically identical cranes without individual slewing rims can be used.

(C) By eliminating the platform used in conventional cranes the height of this type of twin crane can be decreased.

(D) By eliminating the large size slewing rims and gear rings hitherto used in the construction of the base of single cranes, and by omitting in the platform, construction is simplified at the same time as building costs and total weight are reduced.

(E) By eliminating all large size slewing rims in the FIG. 5 (and 6) version and instead using more conventional roller bearings, the difficulties associated with obtaining and purchasing expensive special bearings are avoided.

(F) By the method of construction of this twin crane, and by using the slewing machineries of the individual cranes for operation of the cranes either singly or as a pair, the slewing machinery and provision for power supply hitherto used can be avoided, meaning that testing, inspection and maintenance can be more simply carried out.

(G) By the method of construction used, costs of transport and assembly on board ship can be reduced as compared with conventional cranes.

Details of design of the versions described here may be modified within the limits of the claims. Thus, in the versions of FIGS. 1–4 (and 6), a recess may be provided in the middle of the supporting structure instead of at its upper and lower ends, and a bearing be mounted there instead. Again, the number of bearings could, e.g. be increased or that the roller bearings replaced by slide bearings, or the supporting structures and slewing structures be provided with a number of recesses following the principle of the "piano hinge". Another possible modification would be to place the travelling wheels at a greater distance from the common vertical axis of the crane, under each individual crane, for instance.

It should now be apparent that the twin-type slewing crane as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A twin-type slewing crane, comprising:

an upright fixed foundation including a head having a generally horizontal upper, base plate and a generally horizontal lower, supporting plate; said head having a vertical central axis;

a radially outwardly facing ring gear secured on the head to extend circumferentially thereabout, so as to have a vertical axis coinciding with said vertical central axis;

means defining a respective central opening in each of said base plate and supporting plate;

an upright central axle disposed on said vertical central axis in said central openings;

means firmly fixing said central axle to each of said base plate and said supporting plate so that said central axle projects above said base plate and substantially upwards from said head;

said central axle being of substantially smaller outer diameter than said head;

an axially upwardly facing circular track coaxially attached on said base plate;

four roller bearing sets, each having an inner race, an outer race and a plurality of bearing rollers running on said races;

all four of said inner races being mounted on said central axle in axially spaced relation above said base plate;

two individual crane supporting means, one being mounted to the outer races of the uppermost and next-to-lowermost ones of said four roller bearing sets and the other being mounted to the outer races of the lowermost and next-to-uppermost ones of said four roller bearing sets;

each crane supporting means including a generally radially outwardly facing vertical plate having a generally radially outwardly projecting, generally horitonzal lower end shelf;

two individual cranes with a respective winch, each having a luffing jib with means including a hoisting rope running from a winch of that crane to a jib thereof for raising and lowering the jib;

each crane being disposed on and secured to a respective said shelf and being backed against and secured to a respective said vertical plate of a respective said crane supporting means;

each crane supporting means mounting the respective said crane for rotation about said central axis at the same distance from said central axis as the other respective said crane;

an anti-tipping roller means provided on each crane supporting means and disposed in rolling relation with said track; and a rotating mechanism for each crane, including a respective driving gear member projecting therefrom into meshing relationship with said ring gear, whereby operation of the respective said rotating mechanism propels the respective crane about said central axis.

* * * * *